US006405616B1

(12) United States Patent
Chen

(10) Patent No.: US 6,405,616 B1
(45) Date of Patent: Jun. 18, 2002

(54) HAMMER WITH SHOCK-REDUCTION STRUCTURE

(76) Inventor: John Chen, No. 14, Alley 6, Lane 17, Sec. 3, Chung Yang Rd., Lung Ching Hsiang, Taichung Hsien (TW)

( * ) Notice: Subject to any disclaimer, the term of this patent is extended or adjusted under 35 U.S.C. 154(b) by 0 days.

(21) Appl. No.: 09/644,835

(22) Filed: Aug. 24, 2000

(51) Int. Cl.[7] ..... B25D 1/12
(52) U.S. Cl. ..... 81/22; 81/20
(58) Field of Search ..... 87/20, 22

(56) References Cited

U.S. PATENT DOCUMENTS

| | | | | | |
|---|---|---|---|---|---|
| 3,320,985 | A | * | 5/1967 | Maguire et al. | 81/22 |
| 4,548,248 | A | * | 10/1985 | Riemann | 81/22 |
| 5,911,795 | A | * | 6/1999 | Tucker | 81/22 |
| 6,202,511 | B1 | * | 3/2001 | Murray et al. | 81/22 |
| 6,223,627 | B1 | * | 5/2001 | Jan et al. | 81/22 |

* cited by examiner

*Primary Examiner*—James G. Smith
(74) *Attorney, Agent, or Firm*—Bacon & Thomas

(57) ABSTRACT

A hammer with shock-reduction structure includes an integrally formed hammer body and a handle cover. A rear section of the handle is formed with an H shaped rod for being engaged by the handle cover made of plastic or rubber. A plurality of front holes is installed on the lateral side of a front section of the H shaped rod and a plurality of rear holes is installed on the lateral side of a rear section of the H shaped rod. The number of the rear holes is larger than or equal to the number of front holes. A gap between the front holes and rear holes is larger than a gap between two adjacent holes. A tilt reduction portion is installed at the lower distal end of the H shaped rod. The H shaped rod at a rear section of the handle of the hammer is inserted into the handle cover which encloses the tilt reduction portion. A hollow space is formed between the opening and tilt reduction portion. The holes delete and dissipate the reacting force, and the space serves to hinder the transfer of the shock wave from the hammer to the user's hand.

3 Claims, 7 Drawing Sheets

HAMMER WITH SHOCK-REDUCTION STRUCTURE

FIELD OF THE INVENTION

The present invention relates to a hammer with a shock-reduction structure, and especially to a device suitable to be used in a hammer to reduce the reacting force from the knock of a hammer to a user's hand.

BACKGROUND OF THE INVENTION

With reference to FIG. 1. a prior art hammer 10 is illustrated. In general, the portion of the handle 102 that is gripped by the user is further enclosed by a handle cover 20 made of plastics and rubber. The handle cover 20 provides friction between the user's hand and handle for providing a better grip and thus preventing slippage during use. The handle cover 20 has the additional function of reducing the reacting force from the knock of the hammer 10.

When the prior art hammer 10 knocks, the shock-wave from the hammer head 101 is transferred to the handle 102, and then to the rubber handle cover 20. The rubber handle cover 20 is directly and tightly engaged with the handle and the user's hand. The handle cover 20 has a better holding feeling due to the rubber material, however, the cover cannot fully absorb the shock-wave from a knock. Since the shock force from a knock of the hammer is directly transferred to the handle cover 20 through the handle 102, it acts on the user's hand through the handle cover 20 since there is no shock absorption structure or isolating structure as the shock wave transfers in the handle 102. Moreover, in general, the rubber handle cover 20 does not have good elasticity, and therefore, the shock absorption effect is confined. As a user uses the hammer for a long period of time, the reacting shock force from knocking will transfer to the user's hand so that the hand will ache or is even injured.

SUMMARY OF THE INVENTION

Accordingly, the primary object of the present invention is to provide a hammer with a shock-reduction structure. The rear section of the handle is formed as an H shaped rod for being engaged by the handle cover made of plastic or rubber. At a lateral side of a front section of the H shaped rod, a plurality of front holes at selected positions is installed and at a lateral side of a rear section of the H shaped rod, a plurality of rear holes at selected positions is installed. The number of rear holes is larger than or equal to the number of front holes. Thus, a hammer with a shock-reduction structure of the present invention is achieved. The holes delete and dissipate the reacting force, and the space serves to hinder the transfer of the shock wave from the hammer to the user's hand. Therefore, a shock reduction effect of a hammer is achieved.

Another object of the present invention is to provide a hammer with a shock-reduction structure, wherein a lower rear section of the H shaped rod is formed with a groove which is engaged with the handle cover so as to be formed with a space for shock reduction. The space between the bottom of the H shaped rod of the handle and the handle cover serves to block the direct transfer of the shock wave to the user's hand. The handle cover has a predetermined compressing function, which can absorb slight vibrations so that the user's hand has no feeling of vibration.

The various objects and advantages of the present invention will be more readily understood from the following detailed description when read in conjunction with the appended drawings.

DETAILED DESCRIPTION OF THE PREFERRED EMBODIMENTS

Figure 1:
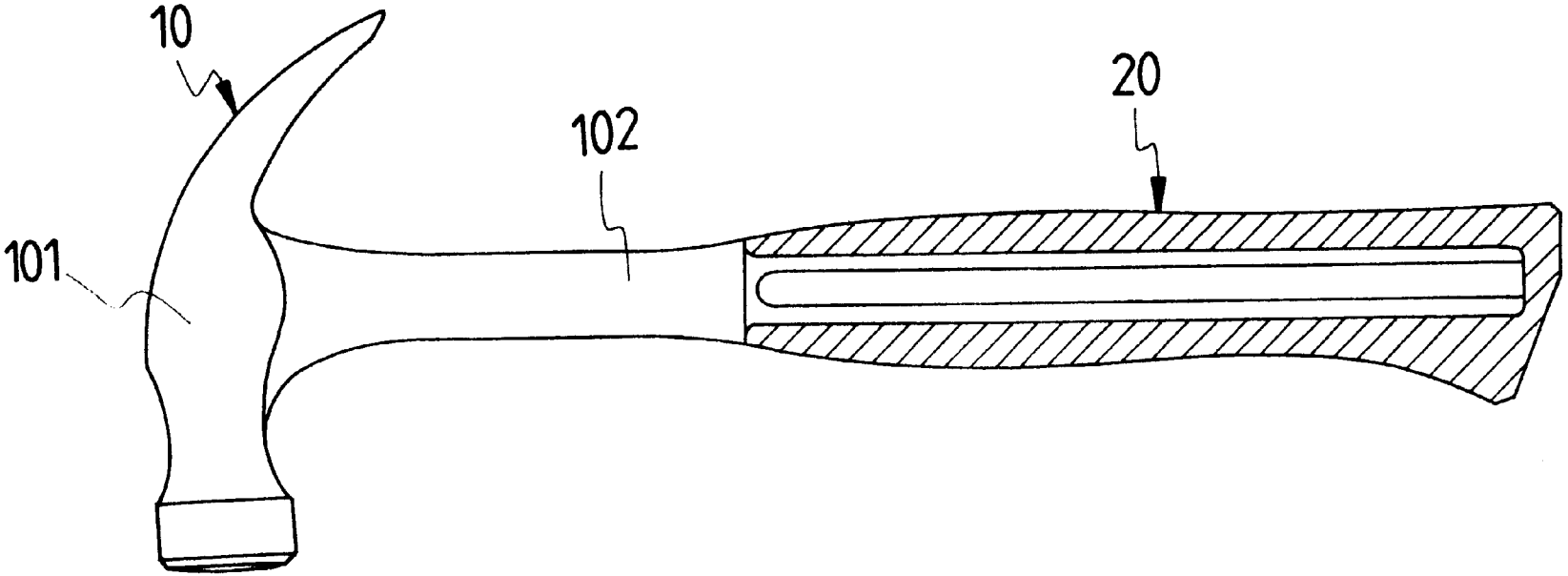
FIG. 1 PRIOR ART
FIG. 1 is a cross sectional view of a prior art hammer structure.
Figure 2:
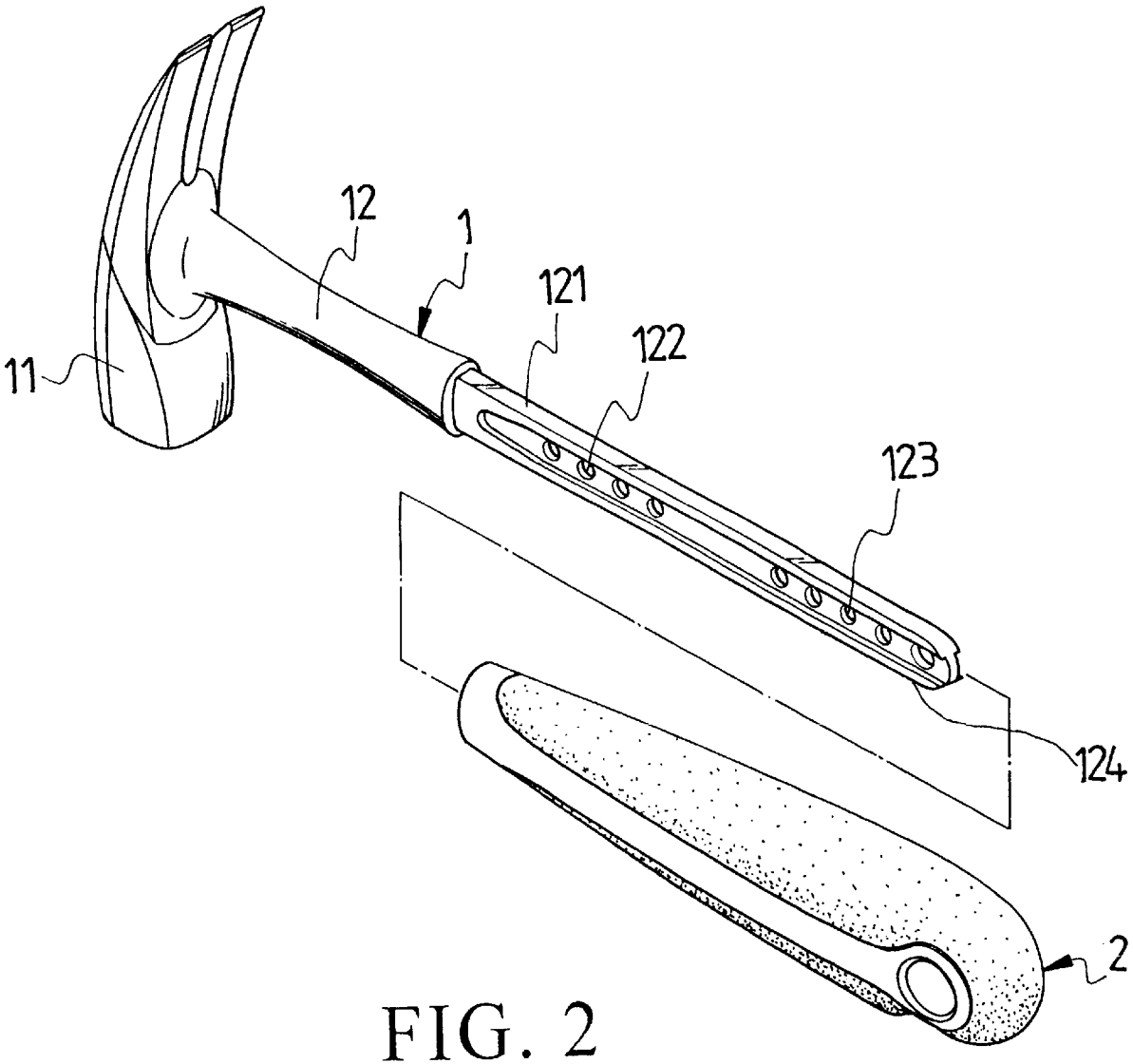
FIG. 2 is an exploded perspective view of the hammer in accordance with the present invention.
Figure 3:
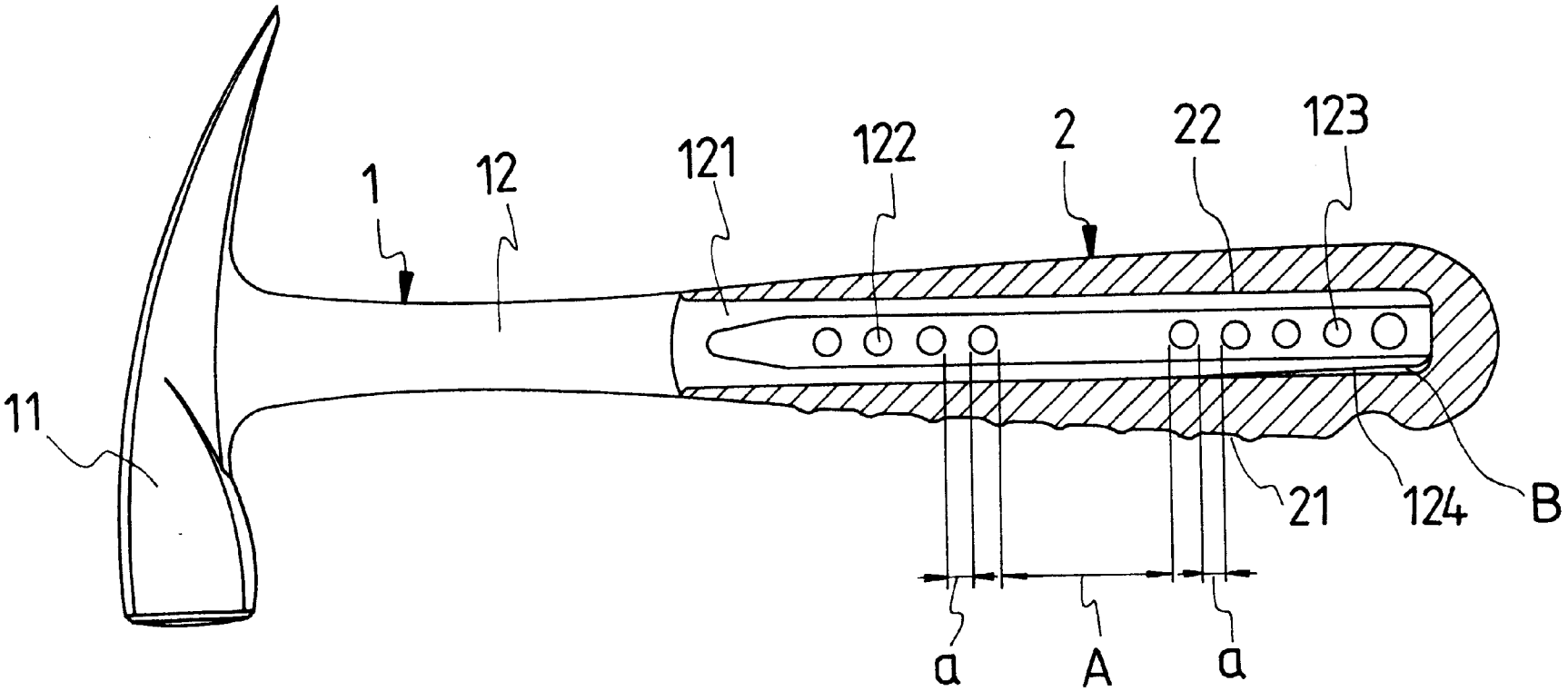
FIG. 3 is an assembled cross sectional view of the hammer in accordance with the present invention.

Referring to FIGS. 2 and 3, a hammer with a shock-reduction structure of the present invention is illustrated. The hammer according to the present invention includes a hammer body 1 and a handle cover 2.

The hammer body 1 is formed integrally and includes a hammer head 11 vertical to a handle 12 which extends transversely to the hammer head 11 at the rear side. The rear section of the handle 12 is formed as an H shaped rod 121 for being engaged with the handle cover 2. A plurality of front holes 122 at selected positions is installed on the lateral side of the front section of the H shaped rod 121. Similarly, a plurality of rear holes 123 at selected positions is installed on the lateral side of the back section of the H shaped rod 121. The number of rear holes 123 must be larger than or equal to the number of front holes 122 (see FIGS. 3 and 4). The gap A between the front holes and rear holes must be larger than the gap between two adjacent holes a in the front section or back section. A tilt reduction portion 124 is installed at the lower side of the H shaped rod 121. The tilt reduction portion 124 extends to the distal end of the handle 12.

The handle cover 2 is made of soft plastic or rubber material and has an elliptic shape. The lower edge thereof is installed with finger holding grooves 21. However, the front end thereof is installed with an opening 22 extending into the interior of the handle cover 2 into which the H-shaped rod 121 at the rear section of the handle 12 is inserted.

Figure 4:
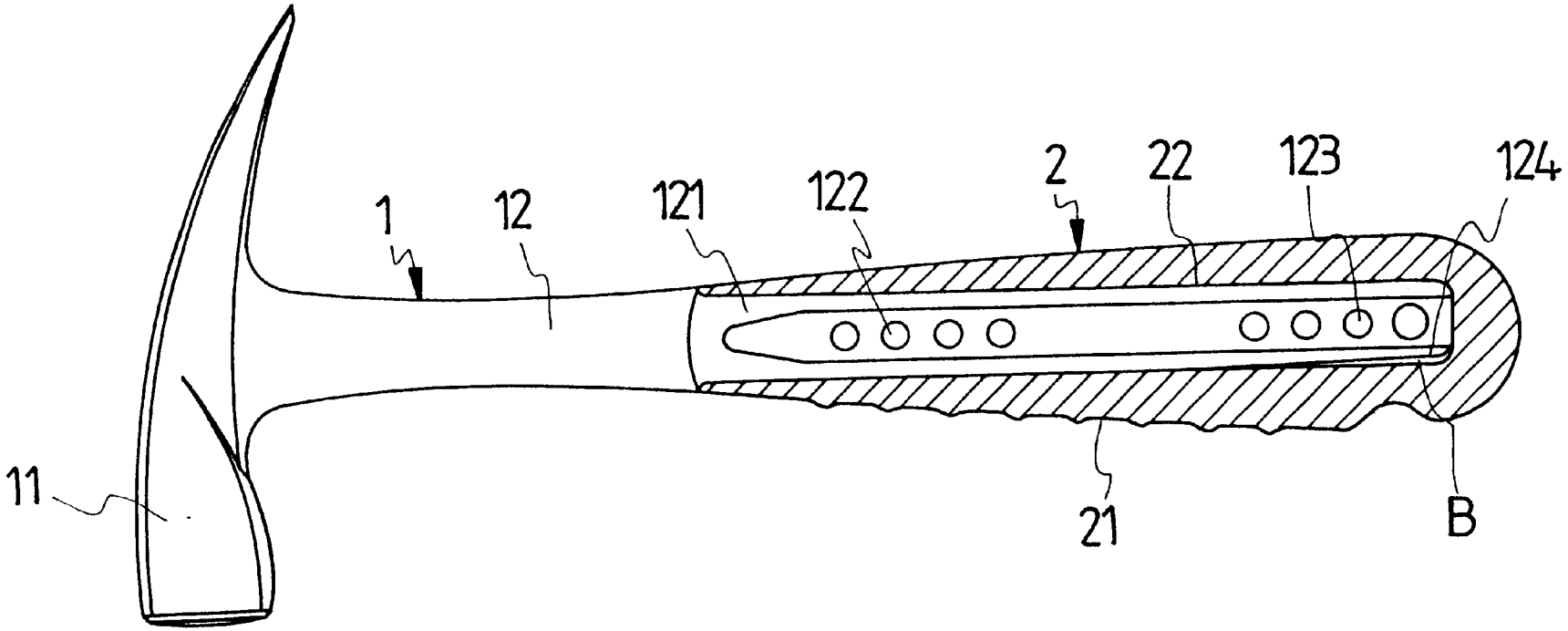
FIG. 4 is a cross sectional view of another embodiment showing the front holes and rear holes in the present invention.

As seen in FIGS. 3 and 4, the handle cover 2 also encloses the tilt reduction portion 124 when assembled. Since the opening 22 of the handle cover 2 is a straight hole, and the tilt reduction portion 124 of the handle 12 is smaller at the distal end, in assembly condition, a hollow space B is formed between the opening 22 and the tilt reduction portion 121 (referring to FIGS. 3 and 4).

Figure 5:
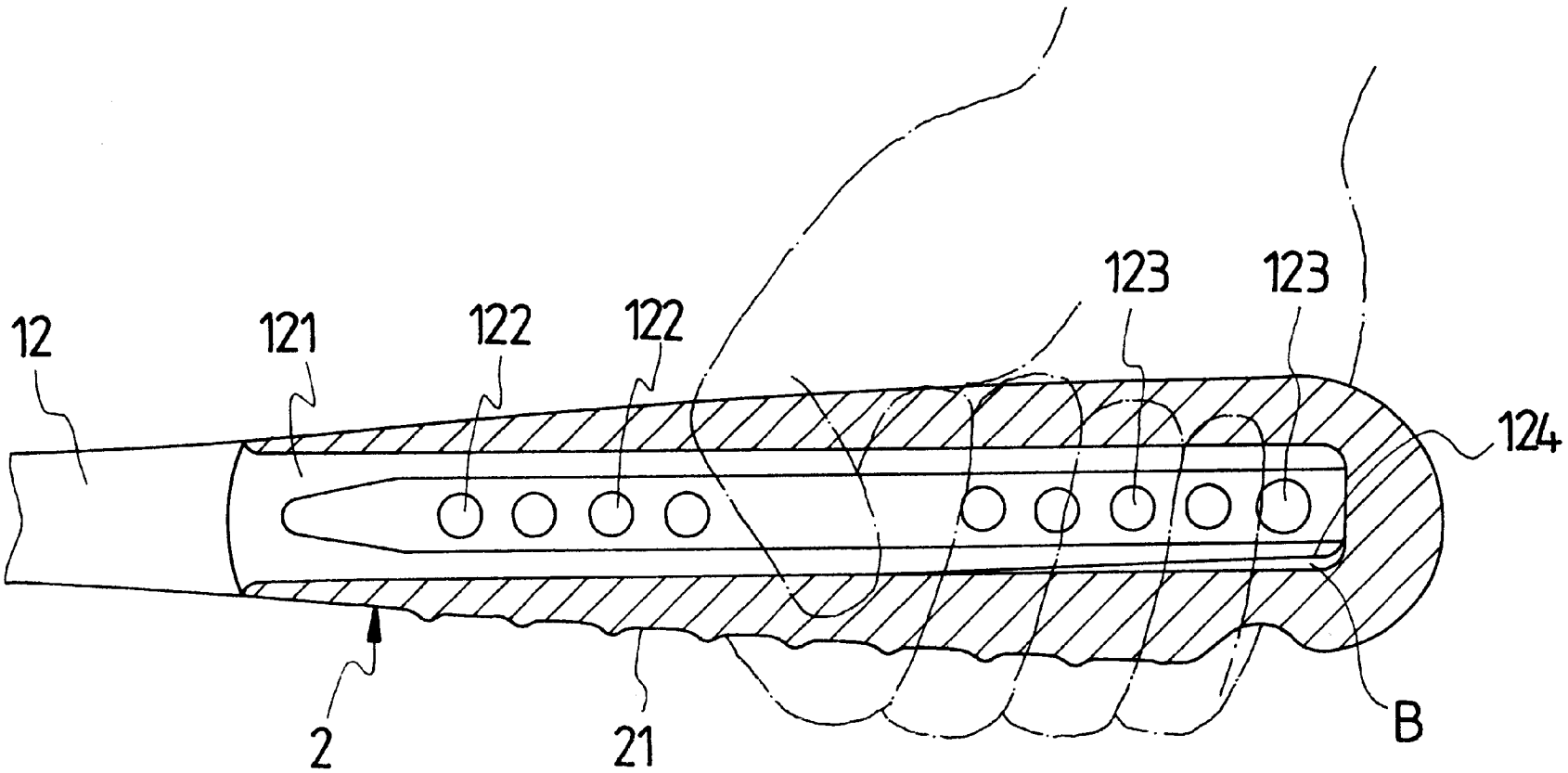
FIG. 5 is a schematic view showing the action of the hammer in the present invention.

In the present invention the hollow space B between the opening 22 and the tilt reduction portion 124, hinders the transfer of the shock-wave to the user's hand, and the front holes 122 and rear holes 123 expand and dissipate the reacting force of the hammer blow, thus, a shock-proof and shock-absorption structure is achieved (see FIG. 5). When the user's hand holds the handle cover 2 over the rear holes 123 the front end of the hand exactly rests against the rear side of the front holes 122. When the hammer is used when held as described above, the shock wave from the knocking of the hammer will be transferred to the handle 12. The front holes 122 will then expand, delete and reduce the shock wave as it travels up the handle 12. The reduced shock wave is then further expanded, deleted and then reduced by the rear holes 123. The space B between the tilt reduction portion 124 at the bottom of the H shaped rod 121 of the handle 12 and the handle cover 2 serves to further hinder the direct transfer of the shock wave. Because handle cover 2 has a predetermined compressing function, it can absorb slight vibrations so that the user's hand has no feeling of vibration. The present invention allows the user to hammer for long periods of time.

Figure 6:
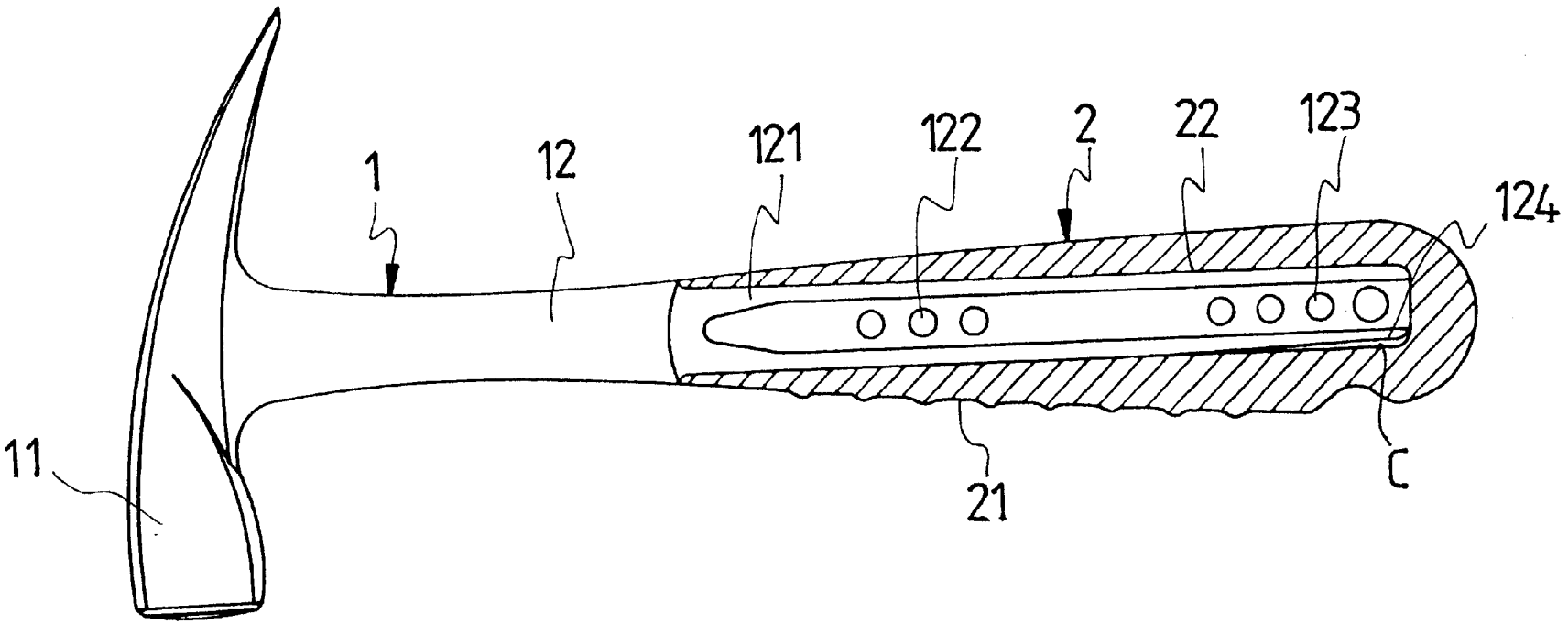
FIG. 6 is a schematic view of a further embodiment of front holes and rear holes in the present invention.
Figure 7:
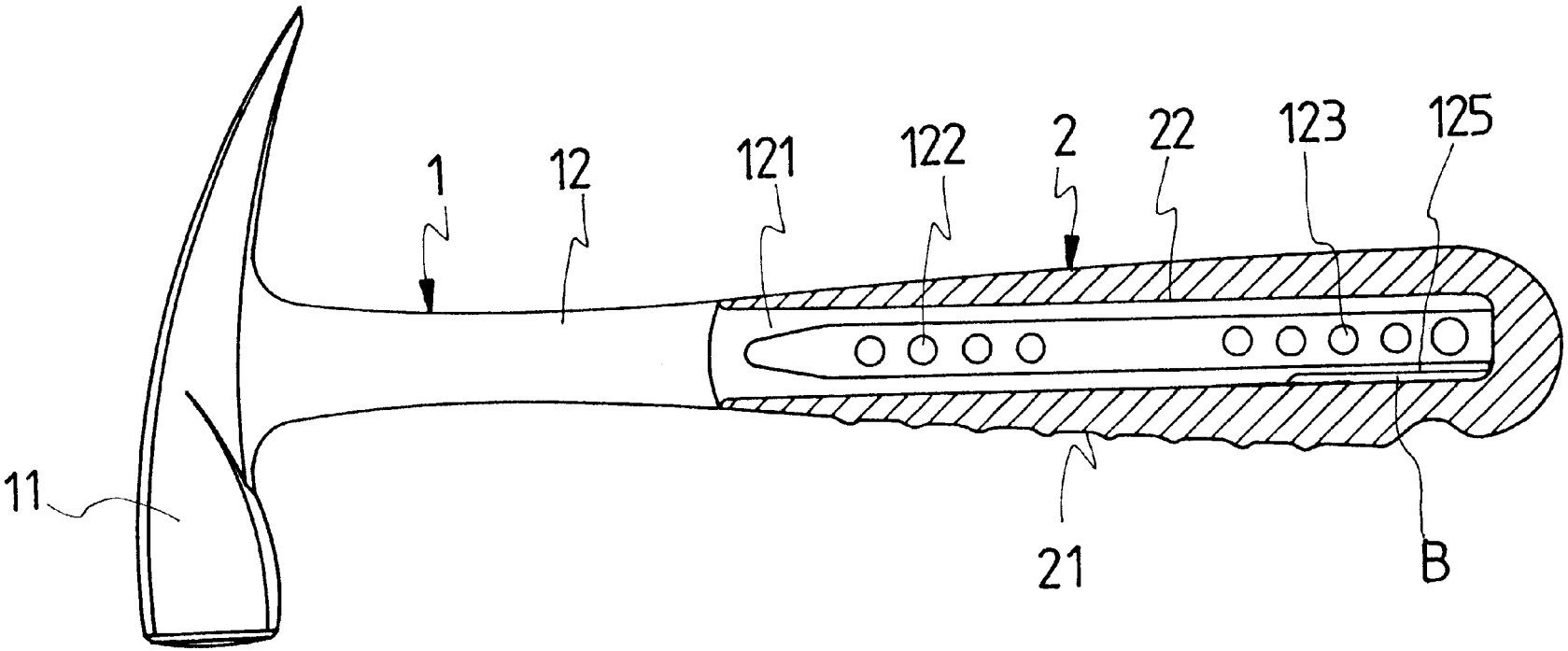
FIG. 7 is a schematic view of an embodiment showing a groove formed at the bottom of the H shape rod in the present invention.

The number of the front holes 122 and rear holes 123 in the H shaped rod 121 may be designed to achieve an identical function. As shown in FIG. 6, the number of the front holes 122 may be equal to 3, and the number of the rear holes 123 may be equal to 4 (the number of the rear holes must be larger than or equal to the number of the front holes). Thereby, a shock reduction structure of a hammer is formed, Furthermore, as shown in FIG. 7, the lower rear section of the H shaped rod 121 can be changed to have a groove 125 to replace the space B so as to achieve the shock reduction effect of the hammer.

Although the present invention has been described with reference to the preferred embodiments. it will be understood that the invention is not limited to the details described thereof. Various substitutions and modifications have been suggested in the foregoing description and others will occur to those of ordinary skill in the art. Therefore all such substitutions and modifications are intended to be embraced within the scope of the invention as defined in the appended claims.

What is claimed is:

1. A hammer with a shock-reduction structure, the hammer comprising:

a hammer body and a handle cover. wherein the hammer body is integrally formed and includes a handle extending transversely at a rear side from a hammer head;

the handle further comprising a back section with an H shaped rod for being engaged by the handle cover, said H shaped rod further comprising:

a lateral side with a front section and a rear section a plurality of front holes installed at selected positions on said front section, and a plurality of rear holes installed at selected positions on said rear section; wherein the number of said rear holes is larger than or equal to the number of said front holes;

a first gap is present between the plurality of front holes and the plurality of rear holes, and said first gap is larger than a gap between two adjacent front holes or two adjacent rear holes.

2. The hammer with shock-reduction structure as claimed in claim 1, the H shaped rod further comprising a groove at a lower rear section of the H shaped rod said groove being arranged such that when the H shaped rod is inserted into the handle cover a space is formed between the handle cover and said groove, thereby reducing shock.

3. The hammer with shock-reduction structure as claimed in claim 1, the H shaped rod further comprising a tilt reduction portion installed at a lower side of the H shaped rod extending to a distal end of the handle. when the H shaped rod is inserted into the handle cover, a hollow space is formed between the handle cover and said tilt reduction portion thereby reducing shock.

* * * * *